United States Patent [19]

Ohsawa

[11] Patent Number: 4,978,053

[45] Date of Patent: Dec. 18, 1990

[54] METHOD FOR MAKING A FRAME-LIKE SHELL

[75] Inventor: Sueo Ohsawa, Kariya, Japan

[73] Assignees: Kabushiki Kaisha Ohsawa Engineering; Toshiba Ceramics Co., Ltd., both of Japan

[21] Appl. No.: 437,794

[22] Filed: Nov. 17, 1989

[51] Int. Cl.[5] ..... B23K 101/24; B22C 21/14; B22D 41/30; B22D 41/32

[52] U.S. Cl. ..... 228/149; 228/173.5; 222/600; 164/411

[58] Field of Search ..... 228/149, 157, 173.4, 228/173.5, 176, 5.7; 222/597, 598, 600; 164/411

[56] References Cited

U.S. PATENT DOCUMENTS

| | | | |
|---|---|---|---|
| 1,060,320 | 4/1913 | Clark | 228/149 |
| 2,571,475 | 10/1951 | O'Donnell | 228/149 |
| 4,627,147 | 12/1986 | Kägi | 222/600 |
| 4,640,455 | 2/1987 | Grein et al. | 228/173.5 |

FOREIGN PATENT DOCUMENTS

| | | | |
|---|---|---|---|
| 177876 | 11/1982 | Japan | 222/600 |
| 188559 | 11/1983 | Japan | 222/600 |
| 38773 | 2/1986 | Japan | 222/600 |
| 57115 | 9/1989 | Japan | 164/411 |
| 2173724 | 10/1986 | United Kingdom | 222/600 |

*Primary Examiner*—Sam Heinrich
*Attorney, Agent, or Firm*—Lorusso & Loud

[57] ABSTRACT

A band-like plate is bent until both ends of the plate meet with each other, and then both ends of the plate are joined by welding so as to make a loop. A pair of first and second inner dies are placed inside the loop while a pair of first and second outer dies are placed outside the loop. The loop is held by the inner and outer dies. At the same time or after that, the loop is pressed by the inner dies when the first and/or second dies move in a given direction.

7 Claims, 2 Drawing Sheets

FIG. 1
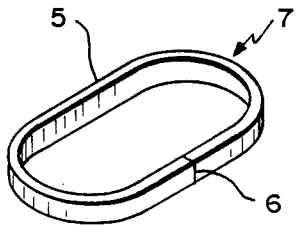
FIG. 2
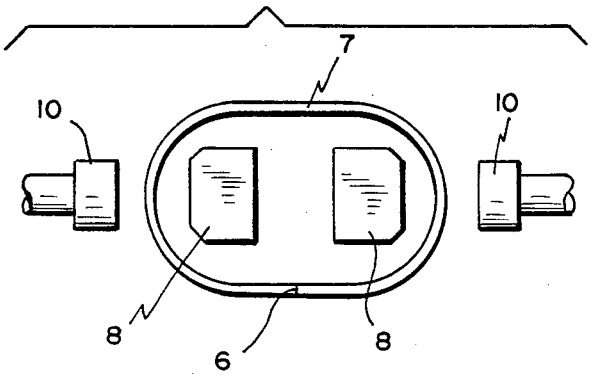
FIG. 3
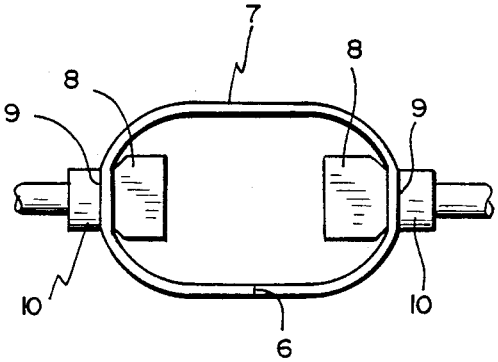
FIG. 4
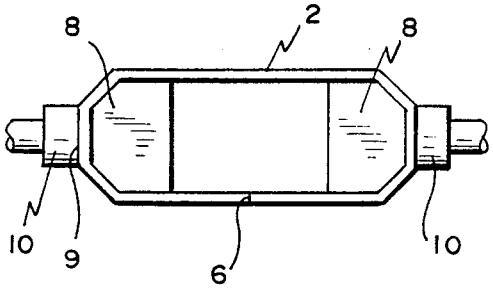
FIG. 5
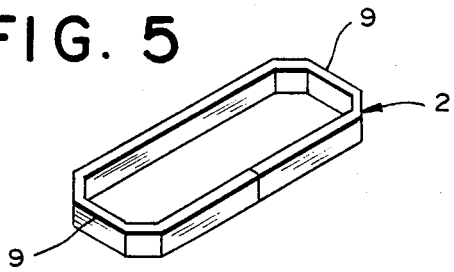
FIG. 6
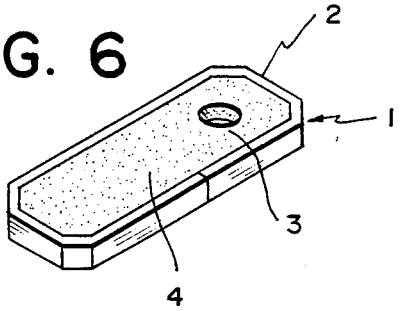
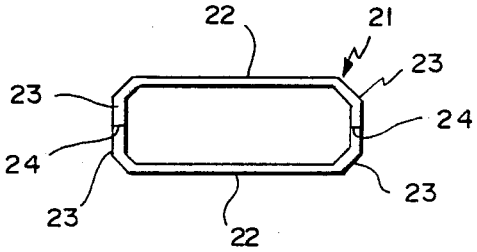
FIG. 7
(PRIOR ART)

METHOD FOR MAKING A FRAME-LIKE SHELL

BACKGROUND OF THE INVENTION

1. Field of the Invention

This invention relates to a method for making a frame-like shell which is to be fixed around a refractory body for reinforcing purposes.

2. Description of Related Art

A refractory has good fire resistance, poor strength and brittleness. A frame-like shell is often used to reinforce the refractory body.

For example, a sliding plate for opening or closing a gate in a continuous steel casting apparatus includes a body made of a refractory material and a frame-like shell made of a metal. The body is fixed within the frame-like shell by a well-known shrinkage fit method.

FIG. 7 shows a conventional frame-like shell 21 into which a sliding plate refractory body is fitted. In order to make the frame-like shell 21, a pair of U-shaped bent members 22 are joined to each other at their opposite ends 23 by two welds 24. When the bent members 22 are formed in a U-shape by a press apparatus, buckling or spring back is apt to take place. Thus, it is difficult to precisely shape the bent members 22. The opposite ends 23 of the bent members 22 are apt to be dislocated when they are joined. If such bent members 22 are joined by the welds 24, they deform.

SUMMARY OF THE INVENTION

The object of this invention is to provide a method for making a frame-like shell which can be precision produced.

According to this invention, there is provided a method for making a frame-like shell into which a refractory member in a steel casting apparatus is fitted, comprising the steps of bending a band-like plate until both ends of the band-like plate meet with each other, joining the ends of the band-like plate by welding so as to make a loop, placing a pair of first and second inner dies inside the loop and a pair of first and second outer dies outside the loop, holding the loop by the first outer and inner dies and by the second outer and inner dies.., and pressing the loop by the first and second inner dies while the loop is held by all of the dies. When the loop is pressed, the first and/or second inner dies move in a given direction. Examples of the refractory member are a sliding plate and a nozzle.

According to this invention, a loop-like plate is formed prior to pressing of a plate in a desired shape. Thus, the deformation due to welding does not directly affect the final product i.e. the frame-like shell. Only one welded portion is formed in the frame-like shell. As the loop-like plate is pressed by the pairs of inner and outer dies, it is possible to produce precisely a frame-like shell, particularly if it is pressed after it is held by the inner and outer dies. In such a case, the bent portions of the frame-like shell are precisely plastic-formed along the inner dies. If the inner dies move precisely, then the bent portions of the loop can be exactly arranged at the opposing positions without any dislocation.

BRIEF DESCRIPTION OF THE DRAWINGS

FIG. 1 is a perspective view showing a loop-like plate which is used in a method for producing a frame-like shell according to this invention;

FIGS. 2 to 4 show three steps of producing a frame-like shell;

FIG. 5 is a perspective view showing the frame-like shell of FIG. 4;

FIG. 6 shows a refractory body fitted in the frame-like shell of FIG. 5;

FIG. 7 is a plan view showing a conventional frame-like shell;

DETAILED DESCRIPTION OF THE PREFERRED EMBODIMENT

Figure 8:
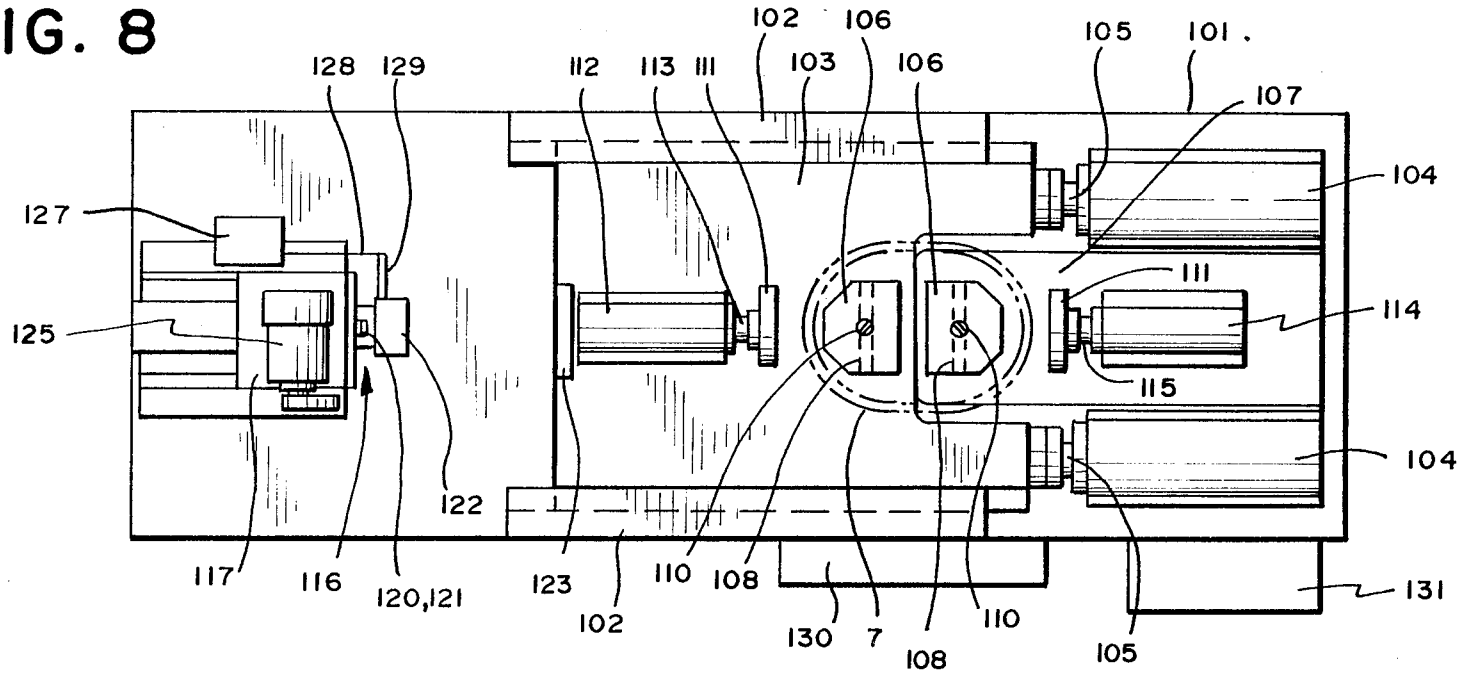
FIG. 8 is a schematic plan view showing an apparatus for carrying out a method of this invention.
Figure 9:
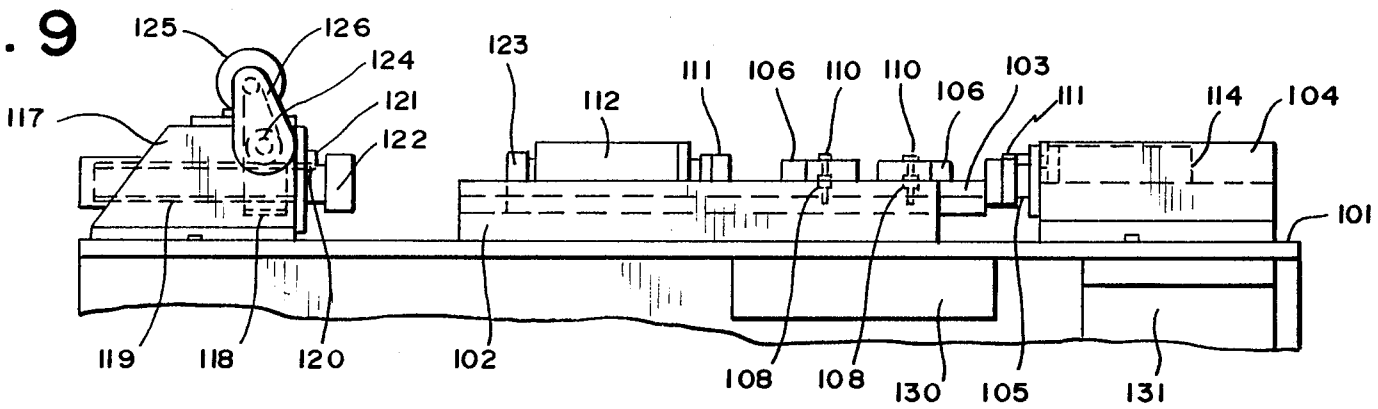
FIG. 9 is a side view, partly broken, of the apparatus of FIG. 8.

FIG. 6 shows a sliding plate 1 which is used to open or close a gate for a conventional steel casting crucible (not shown). The sliding plate 1 includes a frame-like shell 2 and a refractory body 4 fixed in the frame-like shell 2 by a well-known shrinkage fit method. The refractory body 4 has a pouring through-hole 3 in a vertical direction. The refractory body 4 is formed in an elongated octagonal shape, having two bent or beveled end portions. The shell 2 is placed around the refractory body 4 and also forms and elongated octagonal ring or loop. The upper and lower surfaces of the refractory body 4 are substantially flat.

FIG. 5 shows the frame-like shell 2 used in the sliding plate 1. The shell 2 has two bent end portions 9 corresponding to the bent portions of the refractory body 4.

FIGS. 1 to 4 show how to produce the frame-like shell 2.

In FIG. 1, a band-like steel plate 5 has a predetermined thickness such as 6 mm, a predetermined width such as 30 mm and a predetermined length. The band-like plate 5 is bent until both ends of the plate meet with each other. The ends of the plate 5 are fixed by a weld 6 so as to make a ring or loop 7. The loop 7 is preferably shaped in an ellipse or oval.

As shown in FIG. 2, a pair of right and left inner dies 8 are positioned inside the loop 7 while a pair of right and left outer dies 10 are positioned outside the loop 7. All of the dies 8, 10 are aligned in the direction of the major axis of the loop 7.

The inner dies 8 have a pressing surface exactly corresponding to the shape bent end portions 9 of the frame-like shell 2.

As shown in FIG. 3, first, the left inner die 8 moves left (in the drawing) together with a slide (not shown) to a predetermined intermediate position so that both of the right and left inner dies 8 contact the inside of the loop 7. Next, the right and left outer dies 10 move toward the respective inner dies 8 which remain stationary. Thus, the loop 7 is held between and by the inner and outer dies 8, 10.

As shown in FIG. 4, the left dies 8, 10 together move left-wards while the right dies 8, 10 do not move. As a result, when the left dies 8, 10 arrive at their predetermined positions, the loop 7 is pressed or plastic-formed, particularly by the inner dies 8, so as to make a frame-like shell 2 as shown in FIG. 5.

In the above-stated method, it is important that the weld 6 is formed in the loop-like plate 7 prior to the press or plastic-forming step. As the loop-like plate 7 is formed prior to the pressing step, the deformation due to welding does not directly affect the frame-like shell 2. Only one weld 6 is formed in the frame-like shell. The loop-like plate 7 is held by the pairs of inner and outer dies when it is pressed or plastic-formed. Thus, it is possible to produce a frame-like shell with precision because the bent portions of the frame-like shell are plastic-forced along the pressing surface of the inner dies. Also, the bent end portions of the frame-like shell 2 can be easily shaped without any dislocation, spring back or buckling.

The method of this invention can be carried out by an apparatus as disclosed in Japanese Patent Laid-Open No.1-233028 of the same inventor as that of the present application. The apparatus for making the frame-like shell 2 includes a long apparatus body 101, a pair of first and second inner dies 106, the first inner die 106 being fixed relative to the apparatus body 101, a slide 103 slidable along the apparatus body 101 for moving the second inner die 106 along the apparatus body 101, a pair of first and second outer dies 111 so arranged as to face the first and second inner dies 106, respectively, a first mechanism fixed relative to the apparatus body 101 for moving the first outer die 111 toward the first inner die 106 so as to hold the loop 7, a second mechanism fixed relative to the slide 103 for moving the second outer die 111 toward the second inner die 106 so as to hold the loop 7, a third mechanism fixed relative to the apparatus 101 for moving the slide 103 along the apparatus body 101 so as to press the loop 7 by both inner dies 106, and a stop means 116 fixed relative to the apparatus body 101 defining a stop position of the slide 103.

A pair of guides 102 is fixed on the apparatus body 101 at its upper and intermediate sides. The slide 103 can slide on the guides 2 in a longitudinal direction. A pair of pressing piston rods 105 for cylinder means 104 fixed to the body 101 is joined to a right end portion of the slide 103. The first or left inner die 106 is placed on a right end portion of the slide 103 along its center line. The second or right inner die 106 is placed on a base 107 which is fixed on the body 101 in such a way that both inner dies 106 can be arranged adjacent to each other. The keys 108 projecting from the inner dies 106 are set in key grooves 109 formed in the slide 103 and the base 107, respectively. They are detachably fixed by two bolts 110. The first or left outer die 111 is joined to a holding piston rod 113 for a cylinder means 112 fixed to the slide 103. The second or right outer die 111 is joined to a holding piston rod 115 for a cylinder means 114 fixed to the base 107. The stop means 116 includes a housing 117 fixed to the apparatus body 101, a worm gear 118 supported in the housing 101, a worm 124 engaging therewith, a screw 119 having a long key groove 120, a key 121 set in the key groove 120 and fixed to the housing 117, a motor 125 and a stop member 122. The slide 103 has a stop 123 for contacting the stop member 122. The motor 125 is equipped with a brake (not shown) and connected via a chain rotation transmission mechanism 26 to the worm 124. If the motor 125 starts, the screw 119 moves in the right or left direction by means of the worm gear 118. A digital measure 27 is joined at its end 128 to a bar 129 fixed to the stop 122 so as to indicate the position of the stop member 22. An operation panel 130 is placed at a front side portion of the apparatus body 101 and has plural operation switches. Also, a control panel 131 is placed at a front portion of the body 101.

In operation, the loop 7 of FIG. 1 is placed on the slide 103 and the base 107 between the inner dies 106 and the outer dies 111 as shown by chain lines in FIG. 8. Next, the left inner die 106 moves left-wards to its intermediate position together with the slide 103 by the cylinder means 104 so that the outer ends of both inner dies 106 contact the opposite inside portions of the loop 7. After that, both outer dies 111 are moved toward the respective inner dies 106 by the cylinder means 112, 114 until the loop is held between and by the inner and outer dies 106, 111. Finally, while it is held by the dies, the cylinder means 104 are again actuated so as to move the slide 103 further left-wards until the stop 123 of the slide 103 contacts the stop member 122 of the stop means 116. Thus, the loop is pressed or plastic-formed by both inner dies 106.

What is claimed is:

1. A method for making a frame-like shell into which a refractory member is fitted for use in a steel casting apparatus, comprising the steps of:

bending a band-like plate until both ends of the band-like plate meet with each other;

joining the ends of the band-like plate by welding so as to make a loop;

placing a pair of first and second inner dies inside the loop and a pair of first and second outer dies outside the loop;

holding one end of the loop by the first outer and inner dies and the opposite end of the loop by the second outer and inner dies; and pressing the loop by the first and second inner dies while the loop is held by all of the dies.

2. The method of claim 1, wherein the loop is pressed after it is held by the dies.

3. The method of claim 1, wherein the loop is pressed simultaneously when it is held by the dies.

4. The method of claim 1, wherein the first and second inner dies and the first and second outer dies are aligned in a given direction.

5. The method of claim 1, wherein the loop is shaped in an oval or ellipse.

6. The method of claim 1, wherein the holding step includes:

moving the first inner die to a predetermined intermediate position while the other dies do not move; and moving the outer dies toward the respective inner dies which do not move until the loop is held by them.

7. The method of claim 1, wherein the pressing step includes:

moving the first inner and outer dies which hold the loop while the second inner and outer dies do not move, whereby the loop is pressed by the first and second inner dies.

* * * * *

UNITED STATES PATENT AND TRADEMARK OFFICE

CERTIFICATE OF CORRECTION

PATENT NO. : 4,978,053

DATED : December 18, 1990

INVENTOR(S) : Sueo OHSAWA

It is certified that error appears in the above-identified patent and that said Letters Patent is hereby corrected as shown below:

Col. 1, line 44, "dies..," should read --dies,--.

Col. 2, line 25, "and", second instance, should read --an--; and line 46, after "shape" insert --of the--.

Signed and Sealed this

Twelfth Day of May, 1992

*Attest:*

DOUGLAS B. COMER

*Attesting Officer*

*Acting Commissioner of Patents and Trademarks*